US008077143B2

(12) United States Patent
Panabaker et al.

(10) Patent No.: US 8,077,143 B2
(45) Date of Patent: Dec. 13, 2011

(54) MOTION BASED DISPLAY MANAGEMENT

(75) Inventors: Ruston Panabaker, Bellevue, WA (US); Pasquale DeMaio, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 1080 days.

(21) Appl. No.: 11/863,232

(22) Filed: Sep. 27, 2007

(65) Prior Publication Data

US 2009/0085863 A1 Apr. 2, 2009

(51) Int. Cl.
*G09G 5/00* (2006.01)

(52) U.S. Cl. ..... 345/156; 345/173

(58) Field of Classification Search ..... 345/156–173; 715/850, 862, 863

See application file for complete search history.

(56) References Cited

U.S. PATENT DOCUMENTS

| | | | | |
|---|---|---|---|---|
| 5,949,345 | A | 9/1999 | Beckert et al. | 340/815.41 |
| 6,317,114 | B1 | 11/2001 | Abali | 345/672 |
| 6,801,877 | B2 | 10/2004 | Schiltz et al. | 702/184 |
| 7,073,405 | B2 | 7/2006 | Rioux | 73/866.5 |
| 7,191,281 | B2 | 3/2007 | Bajikar | 711/112 |
| 7,414,611 | B2 * | 8/2008 | Liberty | 345/158 |
| 7,414,705 | B2 * | 8/2008 | Boillot | 356/5.01 |
| 7,667,686 | B2 * | 2/2010 | Suh | 345/156 |
| 7,683,883 | B2 * | 3/2010 | Touma et al. | 345/163 |
| 7,710,396 | B2 * | 5/2010 | Smith et al. | 345/157 |
| 7,782,298 | B2 * | 8/2010 | Smith et al. | 345/157 |
| 7,812,826 | B2 * | 10/2010 | Ording et al. | 345/173 |
| 2004/0125073 | A1 | 7/2004 | Potter et al. | 345/156 |
| 2004/0259591 | A1 | 12/2004 | Grams et al. | 455/556.1 |
| 2006/0017692 | A1 | 1/2006 | Wehrenberg et al. | 345/156 |
| 2006/0044268 | A1 | 3/2006 | Robin et al. | 345/158 |
| 2006/0081771 | A1 | 4/2006 | Eliad Wardimon | 250/221 |
| 2006/0125803 | A1 * | 6/2006 | Westerman et al. | 345/173 |
| 2007/0176898 | A1 * | 8/2007 | Suh | 345/158 |
| 2008/0059915 | A1 * | 3/2008 | Boillot | 715/863 |
| 2008/0084395 | A1 * | 4/2008 | Dawson et al. | 345/168 |
| 2008/0158178 | A1 * | 7/2008 | Hotelling et al. | 345/173 |
| 2008/0165136 | A1 * | 7/2008 | Christie et al. | 345/173 |
| 2008/0273755 | A1 * | 11/2008 | Hildreth | 382/103 |
| 2010/0251186 | A1 * | 9/2010 | Park | 715/850 |
| 2010/0321294 | A1 * | 12/2010 | Pearce et al. | 345/158 |

OTHER PUBLICATIONS

Motion Computing; "*Motion Computing Announces New Tablet PC*"; Mar. 26, 2007; http://news.thomasnet.com/fullstory/514008; 4 pgs.

Suter, B., "*Thinkpad Accelerometer Data—Accessing from .NET*"; accessed Jun. 27, 2007 at http://www.stanford.edu/~bsuter/thinkpad-accelerometer/; 5 pgs.

* cited by examiner

*Primary Examiner* — Nitin Patel
(74) *Attorney, Agent, or Firm* — Merchant & Gould

(57) ABSTRACT

A display manager is configured to handle the drawing of windows on one or more displays for an application differently based on detected motion information that is associated with a device. The display manager may not display windows for some applications while motion is detected, while the display manager may display windows for other applications even when motion is detected. Motion enabled applications may interact with the display manager and motion information to determine how to display windows while motion is detected.

20 Claims, 5 Drawing Sheets

MOTION BASED DISPLAY MANAGEMENT

BACKGROUND

Computers today are used in many different environments. Not only are computers common at home, computers are becoming more mainstream in moving devices, such as cars and other moving devices. Computing systems, however, are typically designed for use while stationary. Using these computing systems while a device is in motion can be difficult and even dangerously distracting.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A display manager is configured to handle the drawing of windows for an application on one or more displays based on motion information that is associated with a device. Each of the displays that is associated with the application may be drawn differently. Additionally, each application may use different display characteristics based on the motion. For example, the display manager may not display windows for some applications while motion is detected, while the display manager may display windows for other applications even when motion is detected. Motion enabled applications may interact with the display manager and the motion information to determine how to display windows while motion is detected.

DETAILED DESCRIPTION

Figure 1:
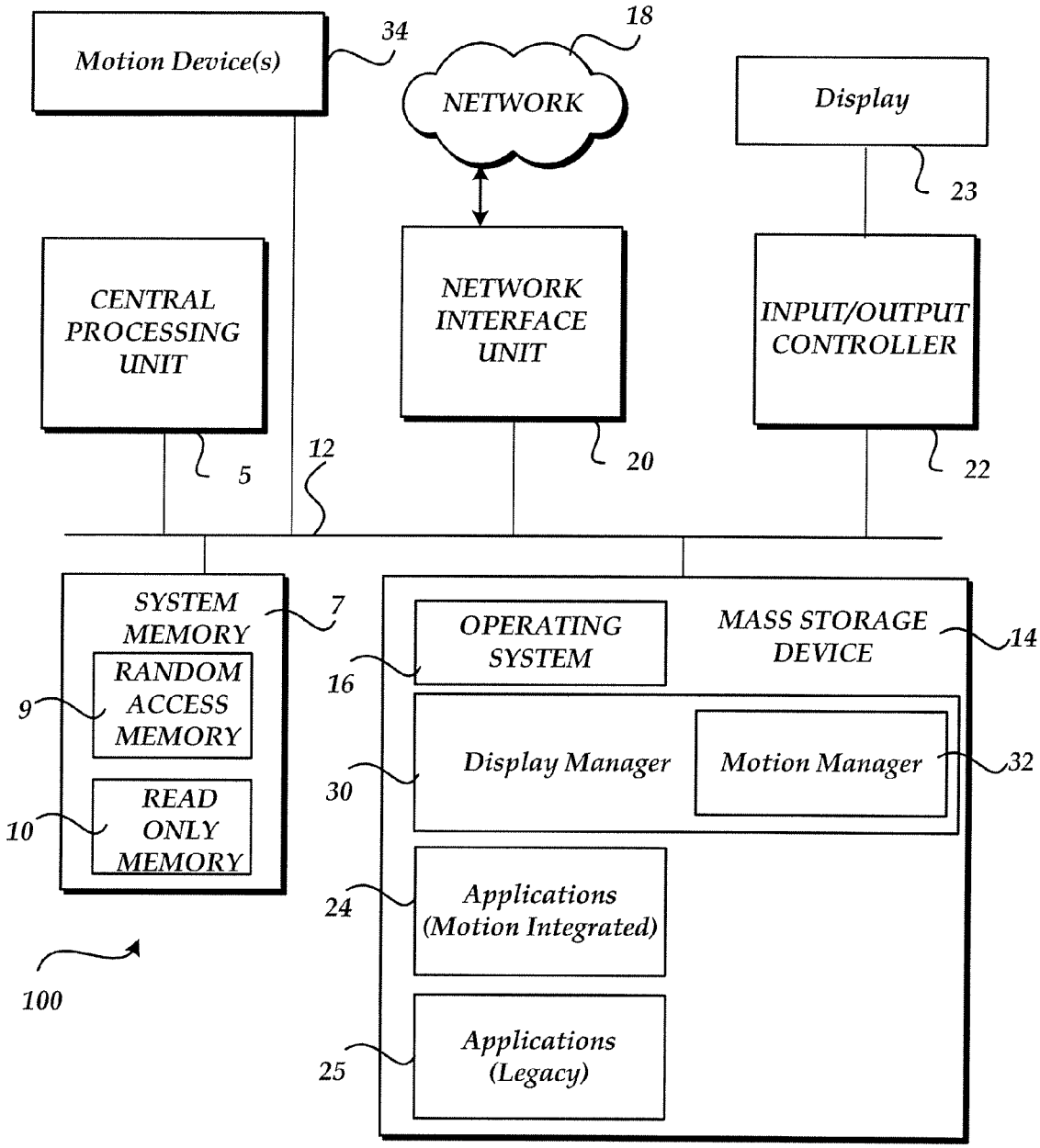
FIG. 1 illustrates an exemplary computing device.

Referring now to the drawings, in which like numerals represent like elements, various embodiment will be described. In particular, FIG. 1 and the corresponding discussion are intended to provide a brief, general description of a suitable computing environment in which embodiments may be implemented.

Generally, program modules include routines, programs, components, data structures, and other types of structures that perform particular tasks or implement particular abstract data types. Other computer system configurations may also be used, including hand-held devices, multiprocessor systems, microprocessor-based or programmable consumer electronics, minicomputers, mainframe computers, and the like. Distributed computing environments may also be used where tasks are performed by remote processing devices that are linked through a communications network. In a distributed computing environment, program modules may be located in both local and remote memory storage devices.

Referring now to FIG. 1, an illustrative computer architecture for a computer 100 utilized in the various embodiments will be described. While the computer architecture shown in FIG. 1 is generally configured as a mobile computer, it may also be configured as a desktop. Computer 100 includes a central processing unit 5 ("CPU"), a system memory 7, including a random access memory 9 ("RAM") and a read-only memory ("ROM") 10, and a system bus 12 that couples the memory to the central processing unit ("CPU") 5.

A basic input/output system containing the basic routines that help to transfer information between elements within the computer, such as during startup, is stored in the ROM 10. The computer 100 further includes a mass storage device 14 for storing an operating system 16, a display manager 30, a motion manager 32, motion integrated applications 24 and legacy applications 25, which are described in greater detail below.

The mass storage device 14 is connected to the CPU 5 through a mass storage controller (not shown) connected to the bus 12. The mass storage device 14 and its associated computer-readable media provide non-volatile storage for the computer 100. Although the description of computer-readable media contained herein refers to a mass storage device, such as a hard disk or CD-ROM drive, the computer-readable media can be any available media that can be accessed by the computer 100.

By way of example, and not limitation, computer-readable media may comprise computer storage media and communication media. Computer storage media includes volatile and non-volatile, removable and non-removable media implemented in any method or technology for storage of information such as computer-readable instructions, data structures, program modules or other data. Computer storage media includes, but is not limited to, RAM, ROM, Erasable Programmable Read Only Memory ("EPROM"), Electrically Erasable Programmable Read Only Memory ("EEPROM"), flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer 100.

According to various embodiments, computer 100 may operate in a networked environment using logical connections to remote computers through a network 18, such as the Internet. The computer 100 may connect to the network 18 through a network interface unit 20 connected to the bus 12. The network connection may be wireless and/or wired. The network interface unit 20 may also be utilized to connect to other types of networks and remote computer systems. The computer 100 may also include an input/output controller 22 for receiving and processing input from a number of other devices, including a keyboard, mouse, or electronic stylus (not shown in FIG. 1). Similarly, an input/output controller 22 may provide output to a display screen 23, a printer, or other type of output device. The computer 100 also includes one or more motion devices 34 that are designed to provide motion information. The motion devices may include, but are not limited to devices such as global positioning systems, accelerometers, speedometers, cameras, and the like. Generally, any device that determines motion may be utilized.

As mentioned briefly above, a number of program modules and data files may be stored in the mass storage device 14 and RAM 9 of the computer 100, including an operating system 16 suitable for controlling the operation of a networked personal computer, such as the WINDOWS® VISTA® operating system from MICROSOFT® CORPORATION of Redmond, Wash. The operating system may utilize a display manager 30 that is configured to draw graphical windows on the display 23 of the computing device 100. Generally, display manager 30 draws the pixels (e.g. windows) to a display, such as display 23, instead of an application drawing the pixels directly to the display. Motion manager 32 is configured to process information received by motion device(s) 34 and interact with display manager 30. While motion manager 32 is shown within display manager 30, motion manager 32 may be separated from display manager. Additionally, display manager may be configured as part of operating system 16. The mass storage device 14 and RAM 9 may also store one or more program modules. In particular, the mass storage device 14 and the RAM 9 may store one or more motion integrated application programs 24 and legacy applications 25.

Legacy applications are applications that are created without knowledge of motion information that may be exposed by display manager 30. Motion integrated applications are applications that are created that include logic to utilize the motion information that is exposed by display manager 30.

Generally, display manager 30 is configured to determine how to display windows on a display based on the motion data provided by motion devices 34. For example, the display manager 30 may never display windows for some applications while motion is detected, while the display manager 30 may display windows for other applications even when motion is detected. According to one embodiment, when motion is detected, display manager 30 ceases to draw the windows that are associated with the legacy applications 25 currently running. Other applications, such as motion integrated applications 24, may be informed of the motion by display manager 30 and react appropriately based on the functionality of the application. For example, when a device is in motion, a motion integrated application 24 may instruct the display manager to draw a window larger than normal and the application may activate a touchscreen as opposed to receiving input through a keyboard. The display manager 30 may also be configured to change the appearance of windows based on the detected motion (e.g. drawing windows larger, only showing one window on a display, and the like). Additional details regarding the display manager and motion manager will be provided below.

Figure 2:
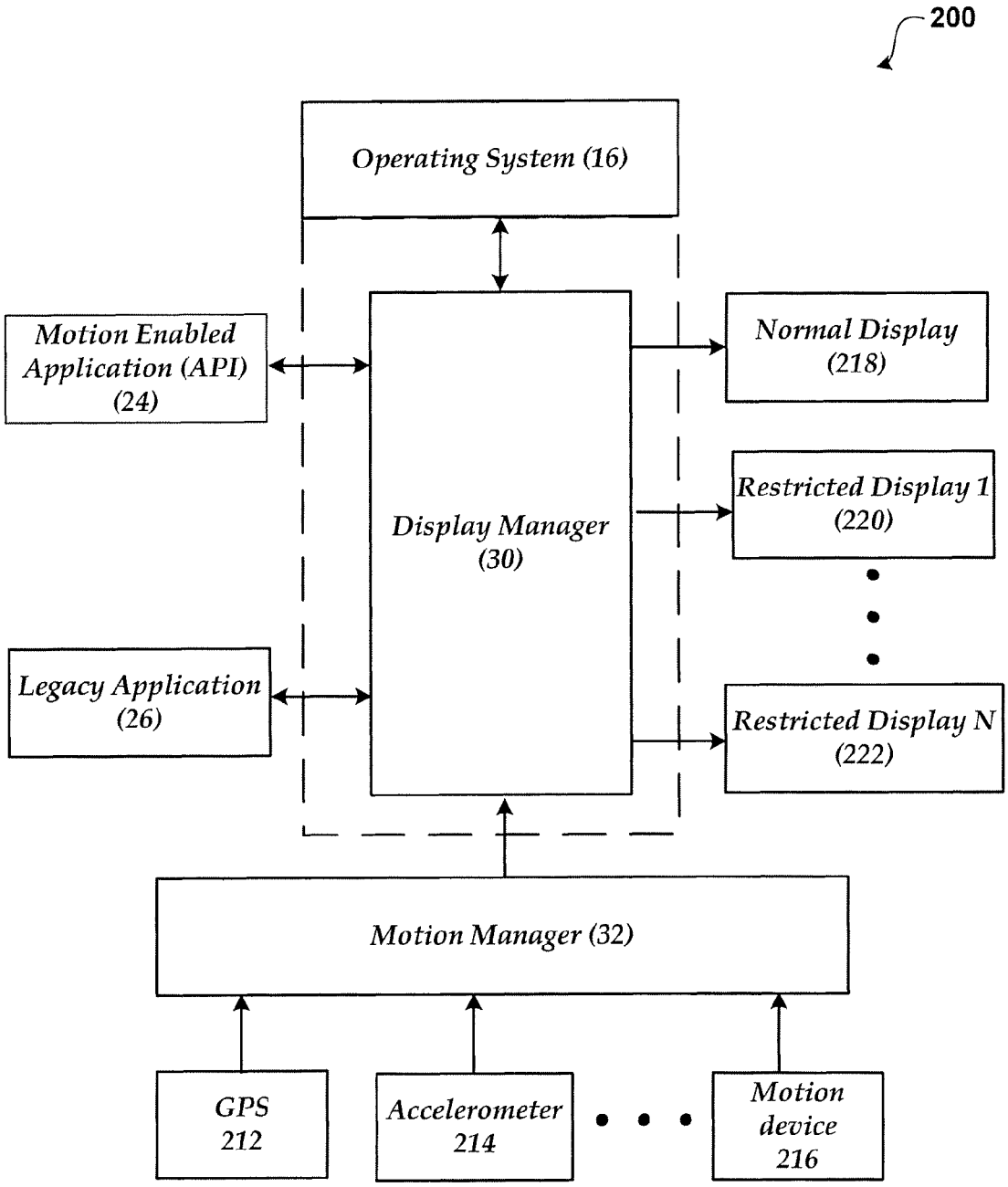
FIG. 2 shows a block diagram of a motion based display management system.

FIG. 2 illustrates a block diagram of a motion based display management system. As illustrated, system 200 includes an operating system 16, a display manager 30, a motion manager 32, Global Positioning System (GPS) 212, accelerometer 214, motion device 216, motion enabled application 24, legacy application 26, normal display 218, restricted display 1 (220) through restricted display N 222. While display manager 30 is illustrated separately from operating system 16, display manager 30 may be incorporated into operating system 16. Similarly, motion manager 32 may be configured as part of display manager 30 and/or operating system 16.

Display manager 30 is located between the applications and the displays and controls the drawing of pixels to the displays. Instead of individual windows that are associated with an application drawing directly to a display, the display manager 30 causes the drawing for an application to be directed to off-screen surfaces in video memory, which are then rendered into a desktop image and presented on the display when determined. Display manager 30 coordinates with motion manager 32 in order to determine motion of a device. Motion manager 32 is configured to receive information from a motion device, such as a GPS device 212, accelerometer 214, or some other motion device 216 and provide the motion manager to windows desktop manager 30. In response to a motion event, the display manager 30 may decide whether or not to draw a window to a display.

According to one embodiment, motion enabled applications 24 have access to motion information through an Application Programming Interface (API). For example, a motion enabled application 24 may have a window displayed even while the device is moving if it makes an API call to acknowledge the motion before the display manager displays the contents of the window. The motion enabled applications may also register for events concerning the motion detected by motion manager 32. The events may related to predetermined motion conditions, such as: speed, location, acceleration, and the like. The motion enabled applications 24 can then make the decision of what is an appropriate display based on the motion events.

As discussed above, a legacy application 26 is not aware of the motion information, and a as a result, does not know when a device is in motion. According to one embodiment, no windows are displayed for a legacy application when motion is detected. According to another embodiment, the display manager 30 may provide an option to bypass the blocking of displaying of windows when motion is detected. The display manager 30 may also be configured show a display indicating that the display has been stopped based on the motion.

In addition to controlling the display of windows to a display, the display manager 30 can change the user interface on a display based on the motion. For example, the default text sizes of a window can be changed, the window controls can be changed (e.g. increased in size), and the like. The shell experience of the display can also change. For example, different menus could be displayed. When the motion of the device stops, or falls below a predetermined threshold, the display manager 30 displays the windows normally.

Motion enabled applications 24 and display manager 30 may also be configured to change behavior based on motion thresholds and/or the location of a display within a device. For example, one application may be within a car that allows displays to be shown that are not near a driver when motion is detected. In this example, the displays away from the driver would be treated as a normal display (218). A motion enabled application 24 may also restrict a display depending on the motion. For example, when motion is less than a predetermined amount, restricted display 1 (220) may be used. When motion is greater than a certain amount, restricted display N 222 may be used. Each display that is associated with an application may be treated differently.

Figure 3:
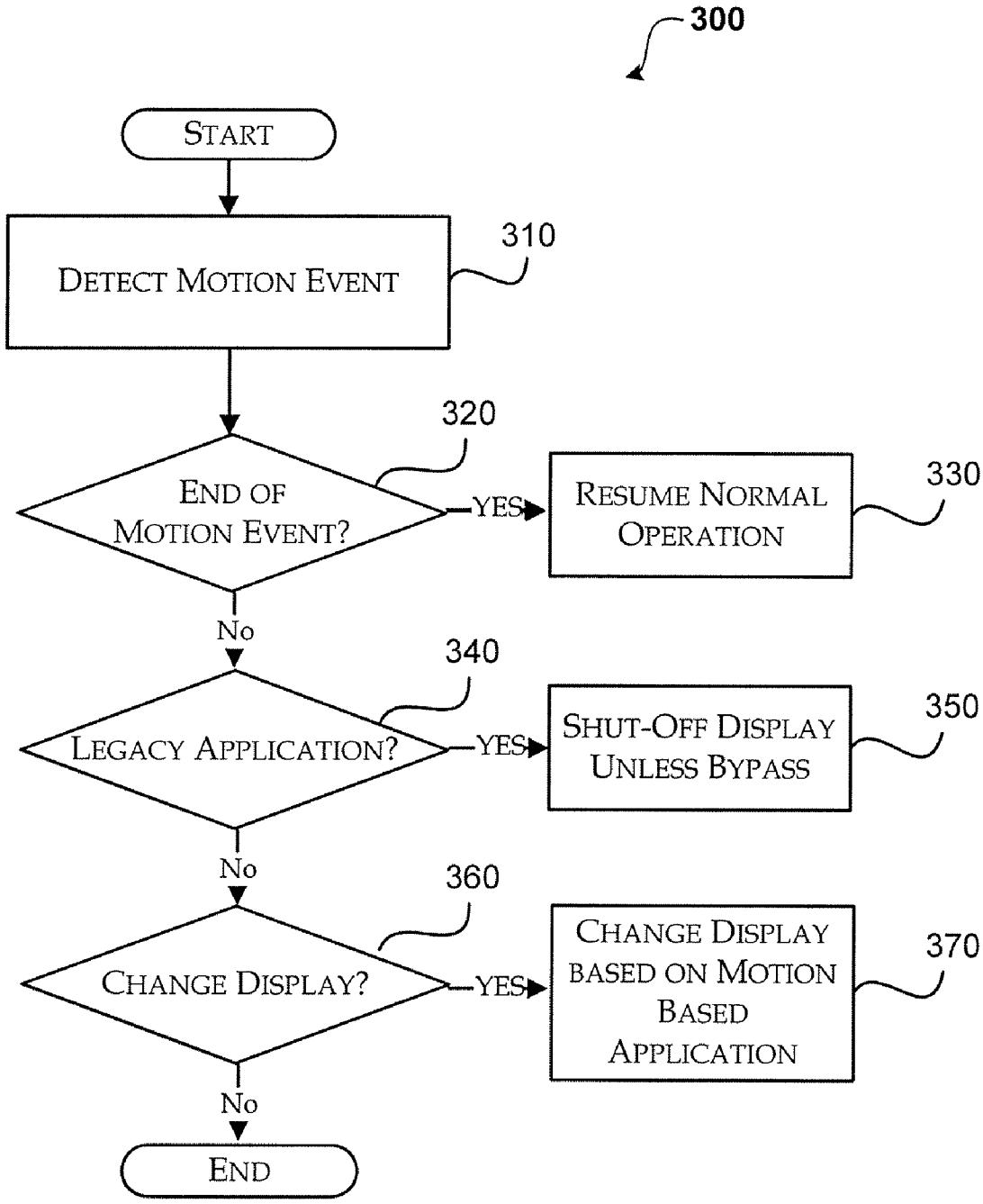
FIG. 3 illustrates a process for managing the displays for legacy applications and motion integrated applications.
Figure 4:
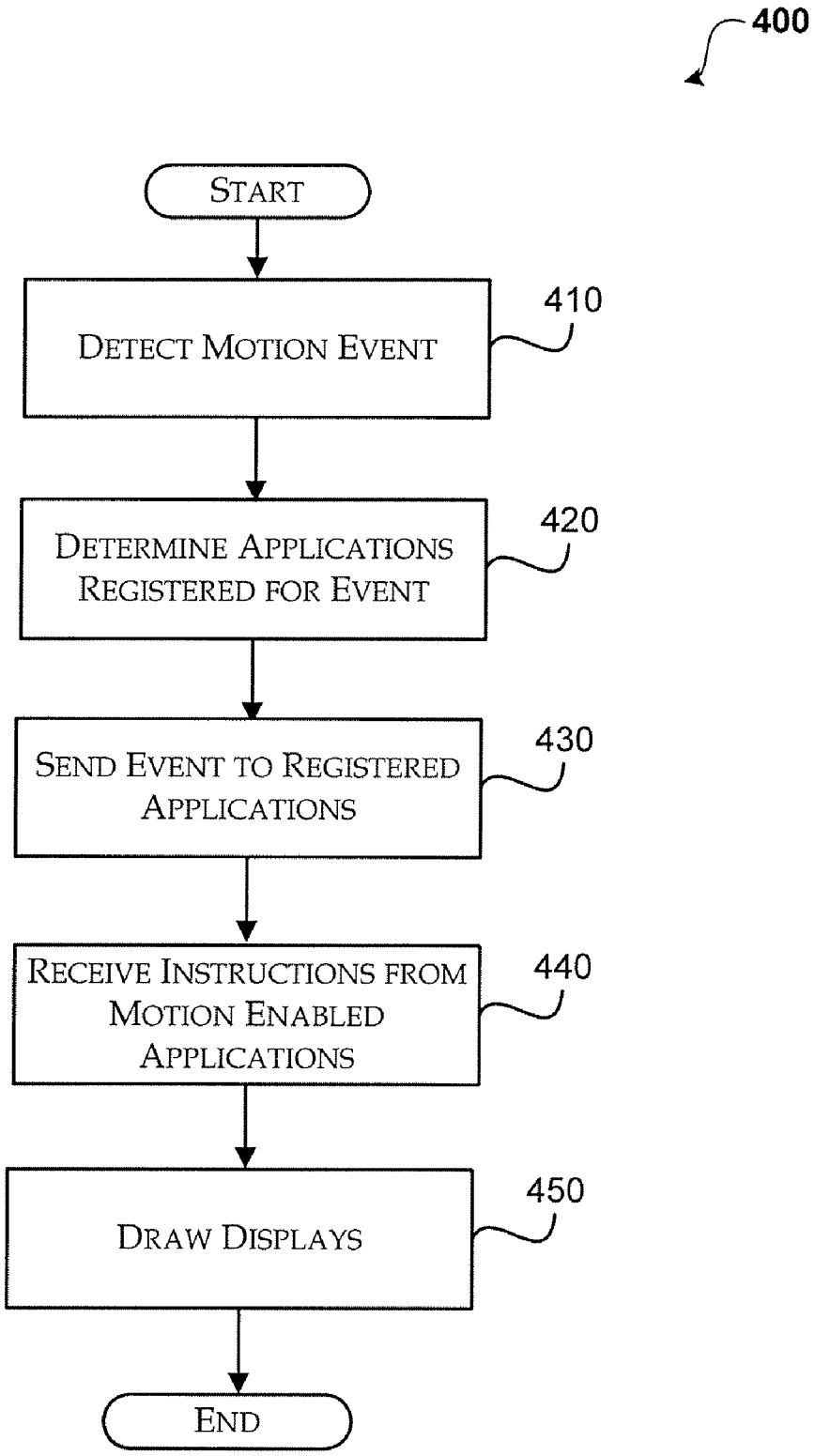
FIG. 4 shows a process for using events for managing the displays of motion integrated applications.
Figure 5:
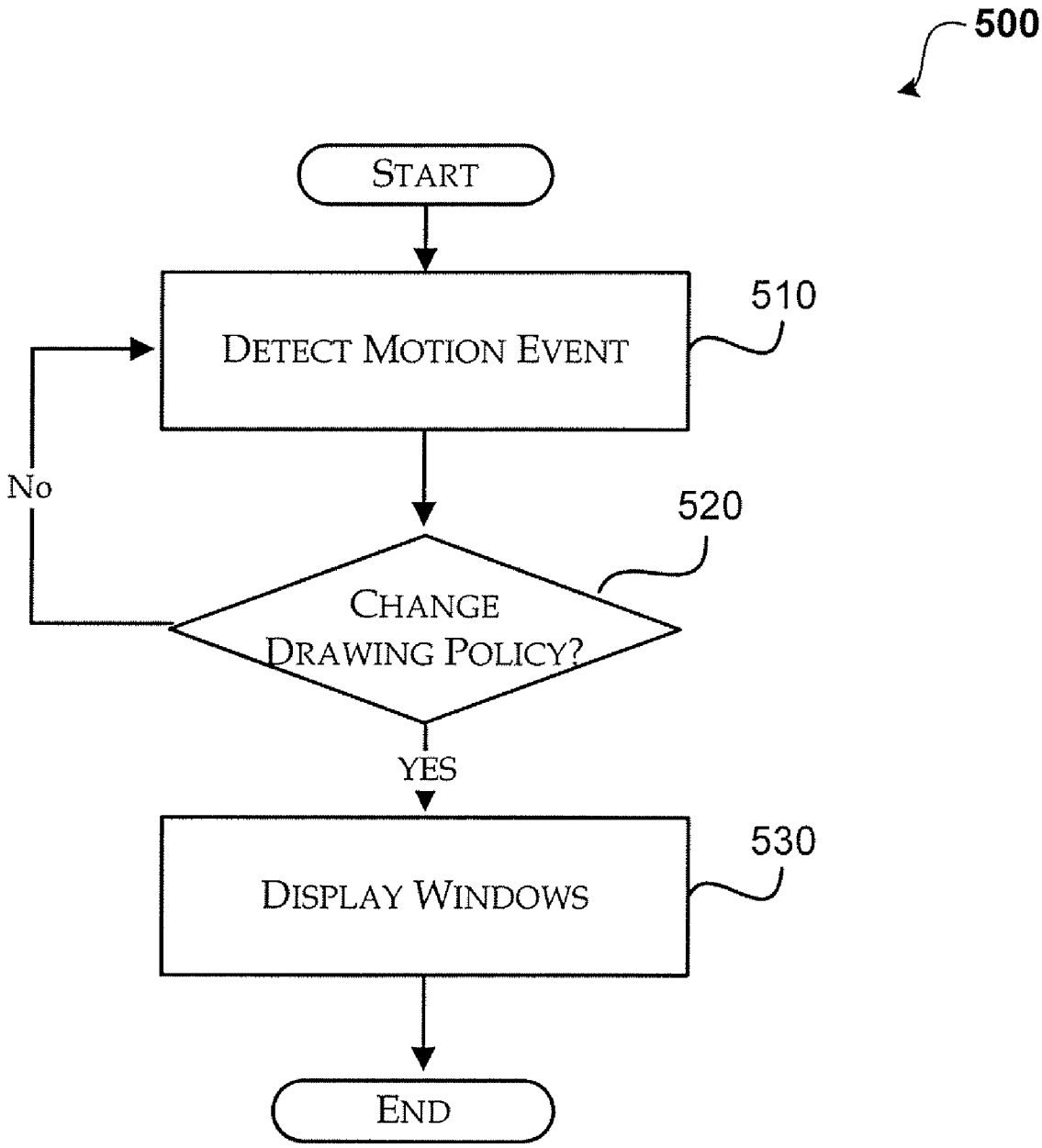
FIG. 5 illustrates a process for changing a drawing policy based on motion.

Referring now to FIGS. 3-5, illustrative processes for motion based display management will be described.

When reading the discussion of the routines presented herein, it should be appreciated that the logical operations of various embodiments are implemented (1) as a sequence of computer implemented acts or program modules running on a computing system and/or (2) as interconnected machine logic circuits or circuit modules within the computing system. The implementation is a matter of choice dependent on the performance requirements of the computing system implementing the invention. Accordingly, the logical operations illustrated and making up the embodiments described herein are referred to variously as operations, structural devices, acts or modules. These operations, structural devices, acts and modules may be implemented in software, in firmware, in special purpose digital logic, and any combination thereof.

Referring now to FIG. 3, a process for managing the displays for legacy applications and motion integrated applications is described.

After a start operation, the process flows to operation 310 where a motion event is detected. A motion event may be configured to be any event based on motion, such as motion detected, motion stopped, certain speed detected; certain acceleration detected; location changed; and the like. According to one embodiment, motion is detected using motion devices including but not limited to: GPS devices; accelerometers; speedometers; cameras and the like.

Moving to decision operation 320 a determination is made as to whether the motion event is an end of motion event. An end of motion event is an event that indicates that no motion is detected and/or the motion is under a predetermined threshold. For example, an end of motion event may be indicated for a device traveling less than three (3) miles per hour or some other predetermined threshold. When the motion event is an end of motion event, the process flows to operation 330 where the display for the application returns to normal operation. During normal operation, the display manager draws the windows on the displays without modification. When the motion event is not an end of motion event (i.e. motion is detected) the process flows to decision operation 340.

At decision operation 340, a determination is made as to whether the application is a legacy application. When the application is legacy application, the process flows to operation 350 where the display for the legacy application is shut-off until an end of motion event is detected. Alternatively, as discussed above, the legacy application may be allowed to display if a bypass has be established for the legacy application. Additionally, some other modification may be made to the display.

When the application is not a legacy application, the process moves to decision operation 360 where a determination is made as to whether the change the display. According to one embodiment, motion integrated applications are treated as legacy applications unless the motion integrated application includes logic to override the default behavior. When the display is to be changed, the process flows to operation 370 where the display is changed. The display change may be many different display changes. For example, the display may be shut-off, the display may be modified (i.e. bigger font, fewer windows, etc.), one display may be modified while another display is allowed to be drawn. When the display is not to change, the process flows to an end operation.

Referring now to FIG. 4, a process for using events for managing the displays of motion integrated applications is described.

After a start operation, the process flows to operation 410 where a motion event is detected as described above.

Moving to operation 420, a determination is made as to what applications have registered for the detected motion event. For example, one application may register for all motion events, whereas another application may only register for a motion event when the device exceeds a certain speed (e.g. 10 mph).

Flowing to operation 430, the motion event is sent to the registered applications. For example, the motion event may be delivered to the applications through a callback mechanism or some other delivery method may be used.

Moving to operation 440, any instructions are received from the motion enabled applications in response to the motion event. The instructions are used by the display manager to determine how to render the display(s) that are associated with the application.

Transitioning to operation 450, the display(s) that are associated with the application are drawn. The process then moves to an end operation.

Referring now to FIG. 5, a process for changing a drawing policy based on motion is described.

After a start operation, the process flows to operation 510 where a motion event is detected as described above.

Moving to decision operation 520, a determination is made as to whether to change the drawing policy of the device. For example, a display manager may determine to only show one window when a motion event is detected, a window may be displayed differently (e.g. larger, bigger fonts, less information), windows may be tiled, and the like. According to one embodiment, the drawing policy change may affect both the drawing for legacy applications as well as the drawing for motion integrated applications. When the drawing policy is not changed, the process returns to operation 510. When the drawing policy is to change, the process flows to operation 530 where the windows are displayed according to the drawing policy. The process the moves to an end block.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A computer-implemented method for managing the display of windows on a computing device, comprising:

displaying a display that is associated an application on a computing device;

detecting a motion event that is associated with movement of the computing device; and disabling the display such that the display is restricted during a duration of the motion event when motion during the motion event exceeds a predetermined threshold based on the detected motion event; wherein the display of the window for the application is changed by a display manager that controls the drawing of windows for applications on the computing device.

2. The method of claim 1, further comprising shutting off the display when the application is a legacy application.

3. The method of claim 1, further comprising determining when the application is to bypass a changing of the display and when determined drawing the display normally.

4. The method of claim 1, further comprising exposing an Application Programming Interface (API) to motion integrated applications such that the motion integrated applications can interact with a display manager and determine how to change the display of the window for the application.

5. The method of claim 4, further comprising while restricting the display not restricting a second display during the motion event.

6. The method of claim 1, further comprising activating the display application when the motion event stops.

7. The method of claim 1, further comprising changing a display policy based on the detected motion event.

8. The method of claim 1, wherein restricting the display changes an appearance of the display.

9. The method of claim 4, further comprising determining applications that have registered for the detected motion event; sending the motion event to the registered applications and receiving instructions regarding the display of window based on the motion event.

10. A computer-readable medium having computer-executable instructions for motion based display management, comprising:

displaying a first display that is associated with a motion integrated application;

displaying a second display that is associated with a legacy application;

detecting motion that is associated with movement of a computing device;

disabling the second display when motion is detected such that it is not drawn during the motion event;

changing display capability for the first display when motion is detected; wherein disabling the second display and changing the display capability for the first display is controlled by a display manager that controls the drawing for applications on the computing device that is independent of the legacy application and the motion integrated application.

11. The computer-readable medium of claim 10, further comprising determining when another legacy application is allowed to display when motion is detected and when allowed displaying a window using the display manager.

12. The computer-readable medium of claim 10, further comprising exposing an Application Programming Interface (API) to the motion integrated application such that the motion integrated application can interact with the display manager to determine how to change the display capability of the first display based on the detected motion.

13. The computer-readable medium of claim 12, further comprising determining applications that have registered for detected motion events that are based on the detected motion events; sending the motion events to the registered applications and receiving instructions regarding display capabilities based on the motion event.

14. The computer-readable medium of claim 13, wherein changing the first display comprises changing a size of text and increasing a size of controls that are associated with the motion integrated application.

15. The computer-readable medium of claim 10, further comprising changing a display policy of the computing device based on the detected motion event; wherein changing the display policy includes changing a number of windows allowed to display.

16. A system for motion based display management, comprising:

a processor and a computer-readable medium;

a display;

an operating environment stored on the computer-readable medium and executing on the processor;

an application;

a motion device that is configured to determine motion for the system;

a display manager operating under the control of the operating environment; wherein the display manager is located between the application and the display and that is operative to:

receive motion information from the motion device;

change display capability for the application based on the received motion information; and restrict a display near a driver of a car in response to the motion information; and draw the display based on the changed display capability.

17. The system of claim 16, wherein the application is a legacy application and changing the display capabilities comprises disabling a display when motion is detected.

18. The system of claim 16, further comprising an Application Programming Interface (API) that provides an interface for the application to interact with the display manager to determine how to change the display capability.

19. The system of claim 18, further comprising determining applications that have registered for detected motion events that are based on the detected motion events; and sending the motion events to the registered applications.

20. The system of claim 16, further comprising changing a display policy of the system based on the motion information; wherein changing the display policy includes changing a number of windows allowed to display.

* * * * *